US006223666B1

(12) United States Patent
Resta

(10) Patent No.: US 6,223,666 B1
(45) Date of Patent: May 1, 2001

(54) QUILTING MACHINE WITH VARIABLE-SPACING STITCHERS

(75) Inventor: Roberto Resta, Faenza (IT)

(73) Assignee: Resta S.r.l., Faenza (IT)

( * ) Notice: Subject to any disclaimer, the term of this patent is extended or adjusted under 35 U.S.C. 154(b) by 0 days.

(21) Appl. No.: 09/526,505

(22) Filed: Mar. 16, 2000

(30) Foreign Application Priority Data

Nov. 11, 1998 (IT) ..... BO98A0621

(51) Int. Cl.[7] ..... D05B 11/00
(52) U.S. Cl. ..... 112/117
(58) Field of Search ..... 112/117, 470.12, 112/163, 220, 221, 470.13

(56) References Cited

U.S. PATENT DOCUMENTS 3,749,037 * 7/1973 Cash ..... 112/117
5,103,747 * 4/1992 Resta et al. ..... 112/117
5,287,820 2/1994 Stutznaecker et al. .
5,832,849 * 11/1998 Kaetterhenry et al. ..... 112/117

FOREIGN PATENT DOCUMENTS 0 931 867 7/1999 (EP) .
2 089 849 6/1982 (GB) .

* cited by examiner

*Primary Examiner*—Ismael Izaguirre
(74) *Attorney, Agent, or Firm*—Guido Modiano; Albert Josif; Daniel O'Byrne

(57) ABSTRACT

A quilting machine which comprises a frame composed of a first beam arranged horizontally above a cloth to be quilted and a second beam arranged below the cloth, the beams being provided with respective guides for the carriages for supporting sewing heads and, respectively, a hook assembly of at least two stitchers, one of which is provided with means for moving one of the sewing heads and the hook assembly synchronously and along the same path and with the same orientation, the carriages that support the sewing head and the hook assembly of a first stitcher supporting respective motor elements for the synchronous movement of the carriages that support the sewing head and the hook assembly of the second stitcher.

9 Claims, 1 Drawing Sheet

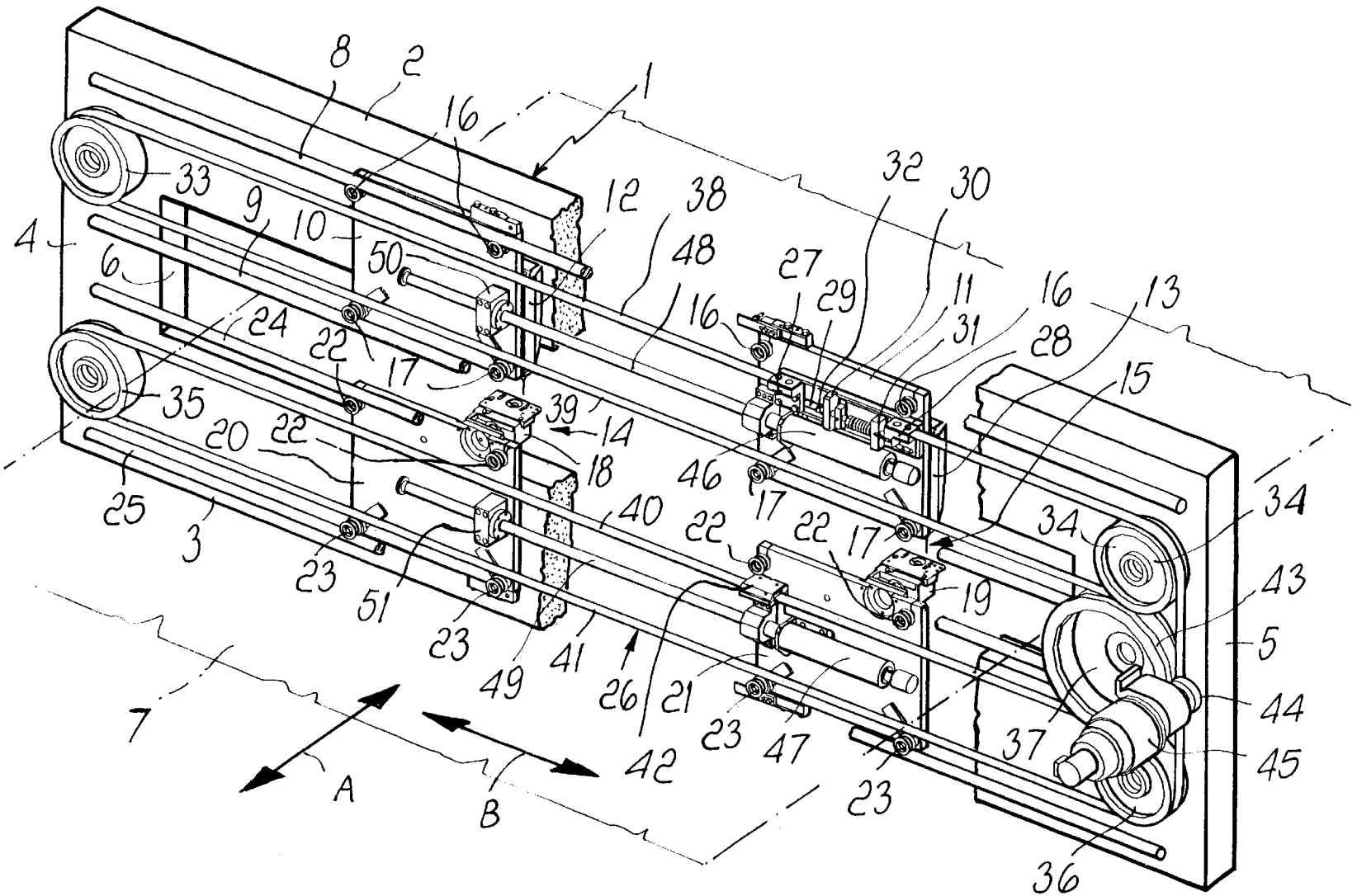
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
A
B

QUILTING MACHINE WITH VARIABLE-SPACING STITCHERS

BACKGROUND OF THE INVENTION

The present invention relates to a quilting machine with variable-spacing stitchers.

It is known that a quilting machine comprises a cloth supporting carriage and a plurality of stitchers which quilt the cloth according to a preset pattern.

In quilting machines, the cloth supporting carriage and the stitchers perform relative movements which allow the sewing needle to move on the cloth with two degrees of freedom in order to form a line of stitches that follows the intended path.

In quilting machines, the stitchers are mounted on a frame which comprises a first beam which lies above the cloth and a second beam which is parallel to the first beam and lies below the cloth.

The first beam supports a guide for the sewing head of the stitcher, while the second beam supports a guide for the so-called hook assembly.

In order to allow the sewing needle to act in cooperation with the hook assembly, mechanical transmissions and/or electrical connections are provided so that the sewing needle moves in step, and in perfect vertical alignment, with the hook assembly during its movements over the cloth.

Conventional quilting machines have operating limitations when it is necessary to manage a plurality of stitchers operating independently of each other so that each one follows an individual path. Because of these difficulties, the stitchers are mostly rigidly connected to each other and can follow only parallel paths.

SUMMARY OF THE INVENTION

The aim of the present invention is therefore to provide a quilting machine without suffering the conventional drawbacks, i.e., which comprises a plurality of stitchers which can be actuated so that they operate independently of each other in order to trace converging and diverging lines of stitches.

This aim is achieved by a quilting machine which comprises a frame composed of a first beam arranged horizontally above a cloth to be quilted and a second beam arranged below said cloth, said beams being provided with respective guides for carriages for supporting a sewing head and, respectively, a hook assembly of at least two stitchers, one of which being provided with means for moving the sewing head and the hook assembly synchronously and along the same path and with the same orientation, characterized in that the carriages that support the sewing head and the hook assembly of a first stitcher support respective motor elements for a synchronous movement of the carriages that support the sewing head and the hook assembly of the second stitcher.

BRIEF DESCRIPTION OF THE DRAWINGS

Further characteristics and advantages of the present invention will become apparent from the description that follows of a preferred embodiment, illustrated only by way of non-limitative example in the accompanying drawing, wherein the only FIGURE is a perspective view of a supporting frame for two stitchers of a quilting machine.

DESCRIPTION OF THE PREFERRED EMBODIMENTS

With reference to the above FIGURE, the reference numeral 1 designates a frame of a quilting machine, which is composed of two horizontal beams 2 and 3 which are mutually superimposed and are connected, at their opposite ends, by two respective vertical uprights 4 and 5.

The beams 2 and 3 and the uprights 4 and 5 enclose an opening 6 through which a cloth 7 to be quilted is fed. For the sake of clarity in presentation, it is assumed that the cloth 7 is stretched horizontally on a frame (not shown) which is movable in a longitudinal direction A at right angles to the frame 1.

Two mutually parallel cylindrical bars 8 and 9 are fixed to the ends of the upper beam 2 and are spaced from the beam. The bars 8 and 9 form a guide along which carriages 10 and 11 are slideable along a transverse path B which is perpendicular to the path A; such carriages support sewing heads 12 and 13 of two stitchers, generally designated by the reference numerals 14 and 15. The sliding of each carriage on the bars 8 and 9 is performed by two pairs of free rollers, the upper ones being designated by the reference numeral 16 and the lower ones being designated by the reference numeral 17. The rollers 16 and 17 are provided with a groove along their peripheral region and tangentially engage above and below the bars 8 and 9.

The stitchers 14 and 15 comprise hook assemblies 18 and 19 which are actuated synchronously with the respective sewing heads 12 and 13. The hook assemblies are mounted on carriages 20 and 21 which, thanks to upper slotted wheel pairs 22 and lower slotted wheel pairs 23, are slideable on two bars 24 and 25 which are fixed, by means of their opposite ends, to the lower beam 3, parallel to the upper parts 8 and 9.

The stitchers 14 and 15 are moved along the transverse path B above the cloth 7 by mechanically connecting the carriages 10 and 20 of the stitcher 14 to the respective carriages 11 and 21 of the stitcher 15 and synchronously actuating such carriages.

The carriages 11 and 21 are actuated by means of a flexible and inextensible belt 26, made for example of steel, whose ends are fixed to two L-shaped elements 27 and 28, the L-shaped element 27 being rigidly fixed to the carriage 11. The other L-shaped element 28 is provided with a threaded stem 29 which protrudes toward the L-shaped element 27 and is guided through two brackets 30 and 31 which are fixed to the carriage 21.

A nut 32 with a respective lock nut are screwed onto the end of the stem 29 that protrudes beyond the bracket 30, so as to provide a screw-type expander which tensions the belt 7 by acting on the L-shaped element 28.

The belt 7 is wound in a closed loop around four guiding pulleys 33, 34, 35 and 36 and a driving pulley 37. The guiding pulleys 33–36 are arranged at the corners of an imaginary rectangle at the opposite ends of the beams 2 and 3. The driving pulley 37 is supported on the upright 3 between the pulleys 34 and 36, so that the belt 26 runs along a zigzag path with four parallel, superimposed and co-planar portions 38, 39, 40, 41, the portions 38 and 40 thereof moving in the same direction, which is opposite to the direction of the portions 39 and 41.

The carriage 21 of the stitcher 15 is fixed to the portion 40 by a clamp 42, so that the two carriages 11 and 21 move correspondingly in the direction of actuation of the belt 26.

For the actuation of the belt 26, the pulley 37 is provided with a ring gear 43 with which there meshes a pinion 44 of an electric motor 45 which is mounted on a bracket (not shown) which cantilevers out from the frame 1. Motion is transmitted from the stitcher 15 to the stitcher 14 by two reversible electric motors 46 and 47 which are mounted on the carriages 11 and 21 and whose shafts are constituted by threaded rods 48 and 49 having the same pitch, extending between the portions 38, 39 and 40, 41 of the belt 26, and being parallel to the bars 8, 9 and 24, 25.

The threaded rods are engaged in female threads 50, 51 which are fixed to the carriages 10, 20 of the stitcher 14. The motors 46, 47 are controlled so as to move with the same angular speed in the same direction.

The operation of the quilting machine is evident from the above description. When the motors 46 and 47 are not moving, control of the motor 45 allows to move the quilting machine 15 in one direction or the other along the transverse path B and therefore to also move in the same direction, by means of the rods 48 and 49, the quilting machine 14, so as to provide two parallel lines of stitches on the cloth 7.

However, by actuating the motors 46 and 47 it is possible to simultaneously move the carriages 10, 20 of the stitcher 14 towards or away from the corresponding carriages 11 and 21 of the stitcher 15, keeping the sewing head 12 in perfect vertical alignment with the respective hook assembly 18. Accordingly, the stitchers 14 and 15 can be moved mutually closer or further apart during their relative movement with respect to the cloth and can form two lines of stitches which follow any convergent or divergent path with respect to each other.

In the practical embodiment of the quilting machine, numerous modifications and variations are possible within the scope of the same inventive concept. For example, it is possible to install a third stitcher on the guides 8, 9, 24, 25 which is controlled like the stitcher 14 by providing on the carriages 11, 21 of the stitcher 15 two additional motors which drive two threaded rods engaging, with a threaded coupling, respective female threads which are fixed on the carriages of the third stitcher. Advantageously, the female thread is of the ballscrew type. Another embodiment uses, instead of the threaded rods 48 and 49, respective racks which have one end fixed to the carriages 10 and 20 and mesh with pinions which are keyed on the output shafts of the motors 46 and 47.

All the details may furthermore be replaced with other technically equivalent elements.

In practice, the materials employed, as well as the dimensions, may be any according to requirements and the state of the art.

What is claimed is:

1. A quilting machine which comprises a frame composed of a first beam arranged horizontally above a cloth to be quilted and a second beam arranged below said cloth, said beams being provided with respective guides for carriages for supporting sewing heads and, respectively, a hook assembly of at least two stitchers, one of which being provided with means for moving one of the sewing heads and the hook assembly synchronously and along a same path and with a same orientation, wherein the carriages that support said one of the sewing heads and the hook assembly of a first stitcher support respective motor elements for synchronous movement of the carriages that support another one the sewing heads and the hook assembly of the second stitcher.

2. The quilting machine according to claim 1, wherein said motor elements comprise electric motors which are supported on the supporting carriages of said one of the sewing heads and of the hook assembly of said first stitcher and are adapted to actuate respective threaded rods which are parallel and are rotatably engaged in female threads which are supported on the carriages that support said another one of the sewing heads and the hook assembly of the second stitcher.

3. The quilting machine according to claim 1, wherein said motor elements comprise electric motors which are supported on the carriages that support said one of the sewing heads and the hook assembly of said first stitcher and are adapted to actuate respective racks which are parallel and have an end which is fixed to the carriages that support said another one of the sewing heads and the hook assembly of said second stitcher.

4. The quilting machine according to claim 2, wherein for the actuation of said first stitcher there is a flexible and inextensible belt which has a point fixed to a carriage of said first stitcher and wound in a closed loop around four guiding pulleys and a driving pulley, said guiding pulleys being arranged on said frame at the corners of an imaginary rectangle and said driving pulley being arranged between two superimposed guiding pulleys so that said belt winds along four parallel, co-planar and superimposed portions which move in a same direction in pairs, the carriages for supporting said one of the sewing heads and, respectively, the hook assembly of said first stitcher being fixed to two of said portions which move in the same direction.

5. The quilting machine according to claim 4, wherein two electric motors of the reversible type are mounted on said carriages, their shafts comprising threaded rods which have the same pitch and are parallel to said portions of the belt and are engaged in female threads which are fixed to the carriages that support said another one of the sewing heads and the hook assembly of said second stitcher, said electric motors being controlled so as to move said carriages with the same speed and in the same direction.

6. The quilting machine according to claim 4, wherein two electric motors of the reversible type are mounted on said carriages, their shafts being provided with pinions which mesh with racks which are parallel to said portions of the belt and have ends which are fixed to the carriages that support said another one of the sewing heads and the hook assembly of said second stitcher, said electric motors being controlled so as to move said carriages with the same speed in the same direction.

7. The quilting machine according to claim 5, comprising a third stitcher which is controlled by providing, on the carriages of said first stitcher, two additional motors for actuating two threaded rods which engage, with a screw coupling, respective female threads which are fixed to the carriages that support the sewing head and the hook assembly of said third stitcher.

8. The quilting machine according to claim 2, wherein said female threads are of the ballscrew type.

9. The quilting machine according to claim 4, wherein said driving pulley is provided with a ring gear with which the pinion of an actuation motor meshes.

* * * * *